US008633808B2

(12) United States Patent
Langer

(10) Patent No.: US 8,633,808 B2
(45) **Date of Patent: *Jan. 21, 2014**

(54) SYSTEMS, METHODS AND APPARATUS FOR LOCATING A LOST REMOTE CONTROL

(71) Applicant: Echostar Technologies LLC, Englewood, CO (US)

(72) Inventor: Paul Langer, Westminster, CO (US)

(73) Assignee: Echostar Technologies LLC, Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/715,949

(22) Filed: Dec. 14, 2012

(65) Prior Publication Data

US 2013/0099905 A1 Apr. 25, 2013

Related U.S. Application Data

(63) Continuation of application No. 12/649,628, filed on Dec. 30, 2009, now Pat. No. 8,339,246.

(51) Int. Cl.
*G08C 19/16* (2006.01)

(52) U.S. Cl.
USPC ..... 340/12.54

(58) Field of Classification Search
USPC ..... 340/12.54, 12.22, 5.6, 426.13; 348/114, 348/211; 341/176
See application file for complete search history.

(56) References Cited

U.S. PATENT DOCUMENTS

| | | | |
|---|---|---|---|
| 4,067,000 | A | 1/1978 | Carlson |
| 4,231,026 | A | 10/1980 | Sullivan |
| 4,578,671 | A | 3/1986 | Flowers |
| 5,115,236 | A | 5/1992 | Kohler |
| 5,164,652 | A | 11/1992 | Johnson et al. |
| 5,204,657 | A | 4/1993 | Prosser et al. |
| 5,294,915 | A | 3/1994 | Owen |
| 5,455,560 | A | 10/1995 | Owen |
| 5,506,572 | A | 4/1996 | Hills et al. |
| 5,598,143 | A | 1/1997 | Wentz |
| 5,638,050 | A | 6/1997 | Sacca et al. |
| 5,926,090 | A | 7/1999 | Taylor et al. |
| 5,945,918 | A | 8/1999 | McGonigal et al. |

(Continued)

FOREIGN PATENT DOCUMENTS

| | | | |
|---|---|---|---|
| GB | 2 331 610 | A | 5/1999 |
| JP | 11-355153 | A | 12/1999 |
| JP | 2000-130848 | A | 5/2000 |

OTHER PUBLICATIONS

International Search Report and Written Opinion of PCT/US2009/066860 mailed on Feb. 11, 2010, 10 pages.

(Continued)

*Primary Examiner* — Vernal Brown

(74) *Attorney, Agent, or Firm* — Kilpatrick Townsend & Stockton LLP

(57) ABSTRACT

Described herein are techniques for locating a lost remote control. The method includes receiving user input, at a controlled device, the user input requesting to locate a lost remote control for the controlled device. The method further includes lowering a volume of the output of content associated with the controlled device responsive to the user input and transmitting a message from the controlled device to the remote control, the message requesting the remote control to activate an indicator device (e.g., sound, visual, physical or the like) of the remote control.

20 Claims, 4 Drawing Sheets

(56) References Cited

U.S. PATENT DOCUMENTS

| | | | |
|---|---|---|---|
| 5,963,010 | A | 10/1999 | Hayashi et al. |
| 5,990,868 | A | 11/1999 | Frederick |
| 5,999,799 | A | 12/1999 | Hu et al. |
| 6,191,551 | B1 | 2/2001 | Fischer et al. |
| 6,373,256 | B1 | 4/2002 | Hanjani et al. |
| 6,535,125 | B2 | 3/2003 | Trivett |
| 6,573,832 | B1 | 6/2003 | Fugere-Ramirez |
| 6,938,101 | B2 | 8/2005 | Hayes et al. |
| 6,985,069 | B2 | 1/2006 | Marmaropoulos |
| 7,009,528 | B2 | 3/2006 | Griep |
| 7,109,848 | B2 | 9/2006 | Schybergson |
| 7,140,033 | B1 | 11/2006 | Durden et al. |
| 8,082,455 | B2 | 12/2011 | Reams |
| 8,134,475 | B2 | 3/2012 | Reams |
| 8,339,246 | B2 | 12/2012 | Langer |
| 2003/0035074 | A1 | 2/2003 | Dubil et al. |
| 2003/0140343 | A1 | 7/2003 | Falvo et al. |
| 2003/0149978 | A1 | 8/2003 | Plotnick |
| 2003/0159146 | A1 | 8/2003 | Kim |
| 2004/0148632 | A1 | 7/2004 | Park et al. |
| 2004/0168187 | A1 | 8/2004 | Chang |
| 2004/0203554 | A1 | 10/2004 | Simon |
| 2005/0105396 | A1 | 5/2005 | Schybergson |
| 2005/0204388 | A1 | 9/2005 | Knudson et al. |
| 2006/0034611 | A1 | 2/2006 | Li |
| 2007/0018845 | A1 | 1/2007 | Sutardja |
| 2007/0162939 | A1 | 7/2007 | Bennett et al. |
| 2008/0088748 | A1 | 4/2008 | Lim |
| 2008/0163049 | A1 | 7/2008 | Krampf |
| 2009/0070840 | A1 | 3/2009 | Kamimaki et al. |
| 2009/0094645 | A1 | 4/2009 | Ting et al. |
| 2009/0243909 | A1 | 10/2009 | Reams |
| 2009/0303097 | A1 | 12/2009 | Reams et al. |
| 2010/0013551 | A1 | 1/2010 | Reams |
| 2010/0154006 | A1 | 6/2010 | Reams |
| 2010/0208146 | A1 | 8/2010 | Reams |
| 2011/0156862 | A1 | 6/2011 | Langer |

OTHER PUBLICATIONS

Osoinach, Bryce, "Proximity Capacitative Sensor Technology for Touch Sensing Applications," Proximity Sensing White Paper prepared for Freescale Semiconductor, Inc., Tempe, Arizona, 2007, 12 pages.

Reams, William R., "Systems and Methods for a Remote Alarm," U.S. Appl. No. 12/336,268, filed Dec. 16, 2008, 26 pages.

Reams, William R., "Systems, Methods and Apparatus for Providing an Audio Indicator Via a Remote Control," U.S. Appl. No. 12/389,272, filed Feb. 19, 2009, 26 pages.

U.S. Appl. No. 12/336,268, filed Dec. 16, 2008, Final Office Action mailed Dec. 30, 2011, 27 pages.

U.S. Appl. No. 12/336,268, filed Dec. 16, 2008, Office Action mailed Jul. 8, 2011, 24 pages.

U.S. Appl. No. 12/389,272, filed Feb. 19, 2009, Office Action mailed Oct. 6, 2011, 13 pages.

U.S. Appl. No. 12/389,272, filed Feb. 19, 2009, Final Office Action mailed May 29, 2012, 17 pages.

U.S. Appl. No. 12/649,628, filed Dec. 30, 2009, Notice of Allowance mailed Aug. 22, 2012, 21 pages.

U.S. Appl. No. 12/389,272 filed Feb. 19, 2009, Final Office Action mailed Oct. 22, 2013, 17 pages.

SYSTEMS, METHODS AND APPARATUS FOR LOCATING A LOST REMOTE CONTROL

BACKGROUND

The creation of the wireless television remote control simplified the television viewing experience for most people, as viewers could remotely operate a television from the couch or other location away from the television. Unfortunately, the wireless television remote control created a new problem plaguing mankind—the lost remote control. Remote controls are easily misplaced, easily hidden under furniture and other objects and can be carried into many locations within a home, making it difficult to locate a lost remote control. Thus, the viewer may spend a significant amount of time trying to locate a lost remote control rather than watching television, leading to a less than desirable viewing experience.

BRIEF DESCRIPTION OF THE DRAWINGS

The same number represents the same element or same type of element in all drawings.

DETAILED DESCRIPTION

The various embodiments described herein generally provide apparatus, systems and methods for providing audible or visual indicators via a remote control for a controlled device. More particularly, the various embodiments described herein generally provide a controlled device, such as an entertainment device, that transmits a request to activate an audio indicator of the associated remote control. The controlled device also mutes the output of presentation content while the remote control activates the audio indicator such that a user may more easily hear the audio indicator of the remote control.

In at least one embodiment, the remote control includes an indicator device, such a speaker, buzzer, light emitting diode, display screen or vibration mechanism. A controlled device associated with the remote control receives user input requesting to activate the indicator device. For example, the user input may request to activate a lost remote control locator feature of the remote control. Responsive to the user input, the controlled device transmits a request to the remote control to activate the indicator device. At substantially the same time, the controlled device may decrease the volume of audio content output by the controlled device or an associated presentation device. For example, a television receiver may mute the output of content to a television or may transmit a command to the television, requesting to mute the volume of the television. Thus, because the volume of the content is decreased or muted, the user has an easier time hearing the output of the indicator device and locating the lost remote control.

Figure 1:
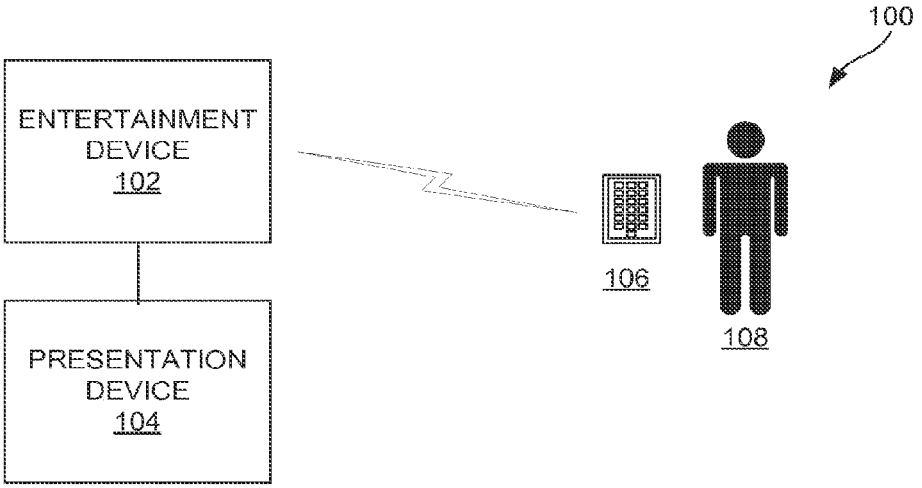
FIG. 1 illustrates an embodiment of an entertainment system.

FIG. 1 illustrates an embodiment of an entertainment system 100. The entertainment system 100 presents content to a user 108. In at least one embodiment, the content presented to the user 108 includes an audio/video stream, such as a television program, movie or other stored or recorded content and the like. The entertainment system 100 includes an entertainment device 102, a presentation device 104 and a remote control 106. Each of these components is discussed in greater detail below. The entertainment system 100 may include other devices, components or elements not illustrated for the sake of brevity.

The entertainment device 102 is operable to receive content from one or more content sources (not shown in FIG. 1) and to present the received content to the user 108 on the associated presentation device 104. In at least one embodiment, the presentation device 104 is a display device (e.g., a television) configured to display content to the user 108. In other embodiments, the presentation device 104 is an audio output device (e.g., stereo system). The entertainment device 102 may receive an audio/video stream in any format (e.g., analog or digital format) and output the audio/video stream for presentation by the presentation device 104. The entertainment device 102 may be further configured to display menus and other information that allow a user 108 to control the output of content by the entertainment device 102 or may include buttons, a touch screen or the like that present information to the user 108 and/or solicit user input from the user 108. In at least one embodiment, the entertainment device 102 is a set-top box (e.g., a satellite or cable television converter box), digital video recorder (DVR) or other similar device that processes and provides one or more audio and/or video output streams to the presentation device 104 for presentation to the user 108. In some embodiments, the entertainment device 102 and the presentation device 104 may be integrated as a device combining the functionality of a display device and a set-top box, DVR or the like or combining the functionality of an audio output device, e.g., a stereo with integrated speakers.

In at least one embodiment, the entertainment device 102 has multiple operating states, corresponding with different available functionalities. For example, a first operating state may correspond with a powered-on state, whereas a second operating state may correspond with a powered-off state. In some embodiments, a first operating state is associated with the entertainment device 102 outputting a menu navigable with the remote control 106.

The remote control 106 may be any system or apparatus configured to remotely control the output of content by the entertainment device 102. For example, the remote control 106 may communicate commands to the entertainment device 102 requesting to playback content, temporally move through content (e.g., fast-forward or reverse), adjust the volume, access electronic programming guides, menus and the like. In some embodiments, the remote control 106 may additionally be configured to remotely control the presentation device 104. The remote control 106 may communicate with the entertainment device 102 and/or the presentation device 104 through any type of wireless communication medium, such as infrared (IR) signals or radio-frequency (RF) signals.

In at least one embodiment, the user 108 requests to activate a lost remote control feature of the entertainment device 102. For example, the user 108 may press an associated button or a front panel of the entertainment device 102. In at least one embodiment, the user 108 may navigate to an appropriate menu of the entertainment device 102, such as using another remote control associated with the entertainment device 102, to activate the lost remote control feature. The entertainment device 102 may also include buttons or other user input interfaces that allow a user 108 to access a remote control locator feature.

Responsive to the user input, the entertainment device 102 transmits a message to the remote control 106, the message requesting the remote control 106 to activate an appropriate audible and/or visual indicator. The entertainment device 102 also decreases the volume of the output of content associated with the entertainment device 102 responsive to the user input. For example, the entertainment device 102 may lower the volume of content outputted by the entertainment device 102 to the presentation device 104. In at least one embodiment, the entertainment device 102 temporarily mutes the volume of content outputted to the presentation device 104.

The entertainment device 102 may also be operable to decrease the volume of a device associated with the entertainment device 102, such as the presentation device 104. For example, the entertainment device 102 may transmit a command to the presentation device 104 requesting to mute the volume of the presentation device 104. Responsive to the command, the presentation device 104 mutes the volume of content outputted therefrom. In at least one embodiment, the entertainment device 102 subsequently transmits a command to the presentation device 104 to increase its volume. For example, the entertainment device 102 may transmit a mute command to the presentation device 104 responsive to input from the user to activate a lost remote control feature and may transmit an un-mote command to the presentation device 104 after a particular periodic interval (e.g., one minute later). Thus, the volume of content is periodically decreased/muted such that the sound emitting device of the remote control 106 is easier for the user 108 to hear.

As described above, the remote control 106 may be operable to periodically query the entertainment device 102 for data/requests, such as requests to activate the sound emitting device. This allows the remote control 106 to power down its receiver during certain periodic intervals to conserve battery power. For example, the remote control 106 may query the entertainment device 102 for operating status information, firmware updates, control command sets and other requests. In at least one embodiment, the queries transmitted by the remote control 106 may request general information from the entertainment device 102. For example, the remote control 106 may request any information to be transmitted from the entertainment device 102. e.g., status requests, commands, software/firmware updates and the like. Thus, the entertainment device 102 may initiate transmission of any data ready to be transmitted to the remote control 106. For example, the entertainment device 102 may transmit a status update, a firmware update and a request to activate an indicator of the remote control responsive to a particular query.

In some embodiments, the remote control 106 may request specific information, such as an operating status of the entertainment device 102. Thus, the entertainment device 102 may transmit the requested information and may queue other data to be transmitted until a later time.

Responsive to a query, the entertainment device 102 may transmit requests to the remote control 106 to undertake specific actions. For example, the entertainment device 102 may request the remote control 106 to activate a sound emitting device, vibration inducing device, light emitting device or other visual indicator. It is to be appreciated that any combination of the aforementioned indicators may be activated by the remote control 106 responsive to the request from the entertainment device 102.

In at least one embodiment, the indicator is activated for a specified period of time (e.g., the request from the entertainment device 102 may specify the fixed period of time). In at least one embodiment, the remote control 106 may deactivate the indicator after a specified period of time in order to conserve battery power. The indicator may also be activated until a specified event occurs (e.g., a button press on the remote control). In at least one embodiment, the entertainment device 102 may subsequently instruct the remote control to deactivate the indicator. For example, in response to some queries, the entertainment device 102 may request the remote control 106 to deactivate the sound emitting device or other indicator.

In at least one embodiment, a query may be transmitted responsive to a specified event. For example, a query may be transmitted a specified period of time after the last receipt of input by the remote control 106. In another example, the remote control 106 may transmit a query responsive to receipt of a particular type of input, e.g., a particular button press. In another example, the remote control 106 may transmit a query to the entertainment device 102 regarding whether to deactivate a sound emitting device responsive to a request by the entertainment device 102 to activate the same.

In at least one embodiment, the queries may be conducted according to a pre-determined schedule. For example, the remote control 106 may query the entertainment device 102 every two seconds requesting any status changes or other data to be exchanged. Thus, the remote control 106 may determine whether to enter a low power mode state based upon the query response.

For example, the remote control 106 may be configured to periodically enter a limited power mode state (e.g., a sleep mode state or stand-by mode state) to conserve battery power. More particularly, components of the remote control 106, such as processors, user input circuitry, transceivers, backlighting, display screens and the like may be commanded to enter a limited power mode state when the functionality of the components is not needed by the entertainment system 100. For example, the remote control 106 may enter a sleep mode state when the entertainment device 102 is powered off. Particular components of the remote control may also enter a limited power mode state if the entertainment device 102 is in an operational state that does not involve soliciting input from the user 108 via the remote control 106.

In at least one embodiment, the remote control 106 queries the entertainment device 102 to determine whether to enter a limited power mode state while operating in an active mode state. For example, the remote control 106 may operate in an active mode state that includes utilizing a touch pad input device in an active mode state to solicit user input for controlling a menu outputted by the entertainment device 102 for display by the presentation device 104. While the touch pad input device operates in the active mode state, the remote control 106 may periodically query the entertainment device 102 to determine whether the entertainment device 102 is still operating in a state that utilizes the touch pad input device. If the operating state of the entertainment device 102 does not need to utilize the touch pad input device (e.g., the entertainment device 102 is no longer outputting a menu), then the remote control 106 may command the touch pad input device to enter a limited power mode state.

In another embodiment, the remote control 106 may operate in an active mode state, and may query the entertainment device 102 and receive a response indicating that the entertainment device 102 has been powered off. For example, the user 108 may have powered off the entertainment device 102 using a front console of the entertainment device 102. Thus, the components of the remote control 106 may enter a limited power mode state, periodically waking to query the entertainment device 102 for operational mode changes (e.g., powering on the entertainment device 102). If an operational mode change is detected by the remote control 106, then appropriate components of the remote control 106 may be commanded to enter an active mode state corresponding with the operational state of the entertainment device 102.

Figure 2:
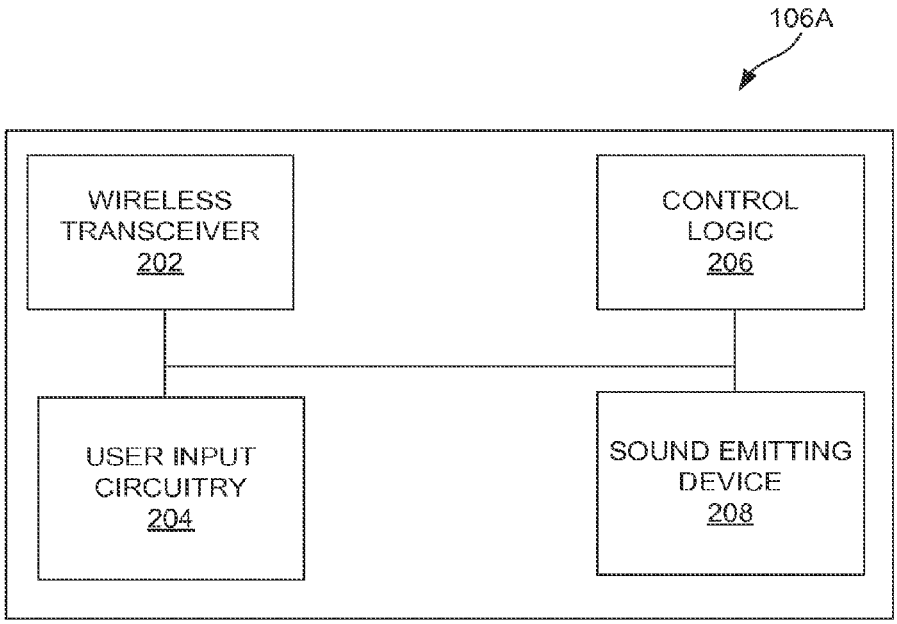
FIG. 2 illustrates an embodiment of a remote control of the entertainment system of FIG. 1.

FIG. 2 illustrates an embodiment of a remote control of the entertainment system 100 of FIG. 1. The remote control 106A includes a wireless transceiver 202, user input circuitry 204, control logic 206 and a sound emitting device 208. Each of these components is discussed in greater detail below. The remote control 106A may contain other devices, such as display screens, backlighting and non-volatile memory, not mentioned herein for the sake of brevity.

The user input circuitry 204 is operable to receive and/or process user input from the user 108 (see FIG. 1). In at least one embodiment, the user input circuitry 204 is a keypad including a set of buttons. The user 108 may utilize the keypad to input channel numbers, control the volume of the entertainment device 102, navigate menus, manipulate the output of content by the entertainment device 102 and/or control other functions of the entertainment device 102 and/or the presentation device 104.

The wireless transceiver 202 is operable to bi-directionally communicate with the entertainment device 102 and/or the presentation device 104. The wireless transceiver 202 may utilize any type of wireless protocol and wireless communication medium, including RF and/or IR key codes or commands, to communicate with the entertainment device 102 (see FIG. 1) and/or the presentation device 104.

The wireless transceiver 202 is operable to transmit a key code and/or command message corresponding with user input to the entertainment device 102. The wireless transceiver 202 is also operable to exchange other data with the entertainment device 102, such as operational status queries and responses. For example, the wireless transceiver 202 may transmit queries to the entertainment device 102 responsive to a pre-defined schedule. The remote control 106A may also receive IR database key codes, RF database key codes or firmware updates from the entertainment device 102 responsive to the queries. In one at least one scenario, the wireless transceiver 202 receives data from the entertainment device 102 requesting to activate the sound emitting device 208. Data received from the entertainment device 102 by the wireless transceiver 202 is transferred to the control logic 206 for processing.

The control logic 206 is operable to control the operation of the remote control 106A. The control logic 206 may be a single processing device or a plurality of processing devices that cooperatively operate to control the operation of the remote control 106. In at least one embodiment, the operation of the remote control 106 may be controlled by instructions executable by the control logic 206. Some examples of instructions are software, program code, and firmware.

The control logic 206 is operable to generate control commands for the entertainment device 102 responsive to the input provided to the user input circuitry 204 by the user 108 (see FIG. 1). The control commands may be in the form of key codes or other commands that are compatible with the entertainment device 102. The control commands may also allow for the control of the presentation device 104. The control logic 206 is also operable to process data received from the entertainment device 102 and/or the display device 104. For example, the control logic 206 may process data received from the entertainment device 102 and activate the sound emitting device 208 to output sounds, such as tones, music, speech and the like.

The sound emitting device 208 may comprise a speaker, a buzzer or other type of device operable to emit sounds perceptible to the user 108 (see FIG. 1). The sound emitting device 208 may include appropriate circuitry for outputting different sounds, tones, frequencies and the like. In some embodiments, the sound emitting device 208 may include voice synthesizer circuitry for outputting synthetic speech data. It is to be appreciated that other types of indicator devices, such as visual indicators (e.g., display screens) or physical indicators (e.g., vibration mechanisms) may be utilized as an alternative or supplement to the sound emitting device 208.

A request from the entertainment device 102 (see FIG. 1) may specify parameters for activation of the sound emitting device 208. For example, the request may specify the tone, frequency, duration, sound or speech (if appropriate) and the like. In some embodiments, the request may specify the purpose of the indicator and the control logic 206 may process the request to determine parameters for activating the sound emitting device 208.

For example, a request from the entertainment device 102 to activate the sound emitting device 208 may be responsive to input from the user 108 requesting to locate the remote control 106A. The control logic 206 may process the request to determine which tone and frequency to output based on the information in the request. In at least one embodiments the control logic 206 is operable to activate the sound emitting device 208 for a specified period of time, e.g., one minute. In some embodiments, the user 108 may deactivate the sound emitting device 208 by providing input to either the remote control 106A, via the user input circuitry 204, or via the entertainment device 102 or presentation device 104.

For example, to deactivate the sound emitting device 208 the user 108 may press one or more buttons of the user input circuitry 204. The control logic 206 then processes the user input and responsively deactivates the sound emitting device 208. If the user 108 provides input via a front panel of the entertainment device 102 or via another remote control for the entertainment device 102, then the entertainment device 102 transmits a request to the remote control 106A to deactivate the sound emitting device 208. The control logic 206 processes the request and deactivates the sound emitting device 208. In at least one embodiment, the request to deactivate the sound emitting device 208 is transmitted to the remote control 106A responsive to a query from the wireless transceiver 202. The control logic 206 may also be operable to deactivate the sound emitting device 208 after a specified period of time (e.g., to conserve battery power).

In at least one embodiment, the remote control 106A may include other types of indicators, such as light emitting devices or other display devices. For example, the remote control 106A may include LEDs or other lights which can be flashed to indicate information to the user 108. In one example, the user input circuitry 204 includes buttons with integrated LEDs. Thus, the buttons of the user input circuitry may be flashed to indicate information to the user 108. The visual indicators may be activated by the control logic 206 in association with the sound emitting device 208 or independently, depending on desired design criteria.

Figure 3:
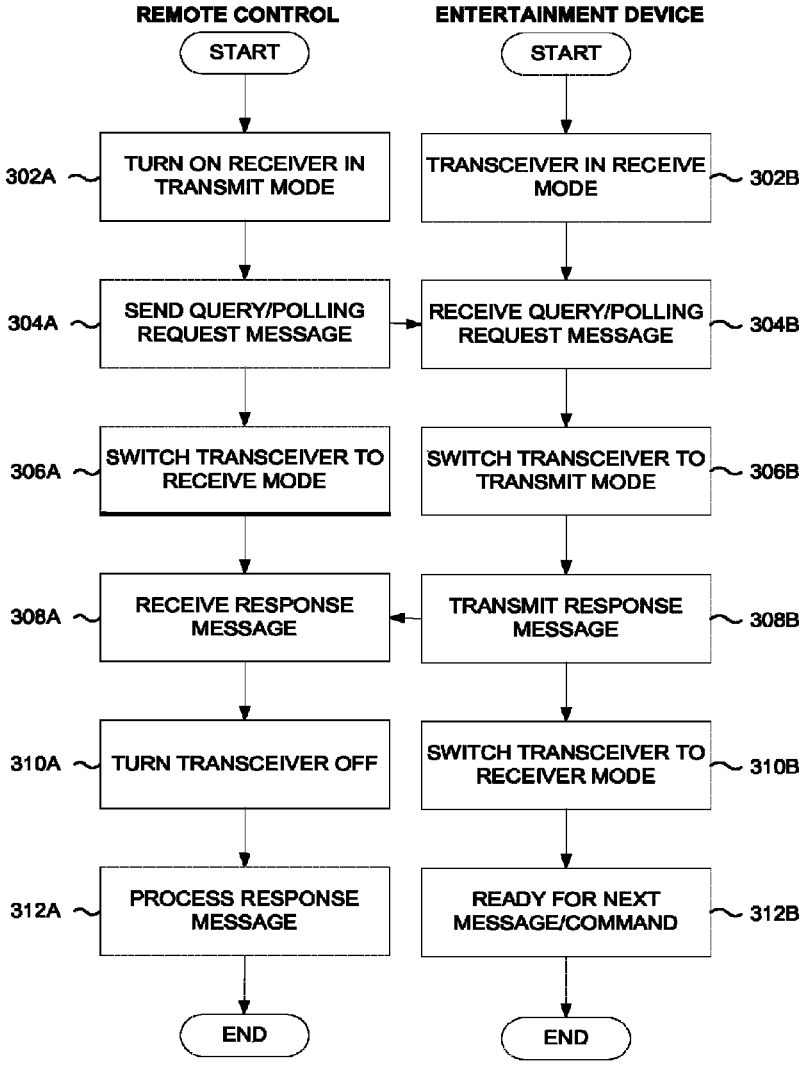
FIG. 3 illustrates an embodiment of a flow chart for a querying process performed by the remote control and the entertainment device of FIG. 2.

FIG. 3 illustrates an embodiment of a flow chart for a querying process performed by the remote control 106A and the entertainment device 102 of FIG. 2. The operation of FIG. 3 will be described in reference to the entertainment system 100 described in FIGS. 1 and 2. The process of FIG. 3 may include other operations not illustrated for the sake of brevity.

As described above, the remote control 106A may periodically query the entertainment device 102 for any type of information, such as states updates and commands from the entertainment device 102, rather than listening for the entertainment device 102 to transmit the information to the remote control 106A. The left side of the flow chart illustrates a process performed by the remote control 106A to query the entertainment device 102. Similarly, the right side of the flow chart illustrates a process performed by the entertainment device 102 to receive and respond to queries from the remote control 106A.

Periodically, the remote control 106A places the wireless transceiver 202 in a transmit mode (operation 302A). At the same time, the entertainment device 102 transceiver operates in a receive mode, ready to receive messages and commands from the wireless transceiver 202 of the remote control 106A (operation 302B).

In operation 304A, the wireless transceiver 202 transmits a query message to the entertainment device 102. After transmitting the query message, the wireless transceiver 202 of the remote control 106A switches to a receive mode, ready to receive a response to the query from the entertainment device (operation 306A). The entertainment device 102 receives the query message (operation 304B) and switches the transceiver of the entertainment device to a transmit mode to respond to the query (operation 306B).

The entertainment device 102 identifies any information to be transmitted to the remote control 106A and transmits a response message to the remote control 106A (operation 308B). For example, the entertainment device 102 may identify firmware updates, power state changes, configuration changes, operational mode changes and requests to activate the sound emitting device 208 of the remote control 106A and transmit such information in the response. In at least one scenario, the entertainment device 102 may transmit a message to the wireless transceiver 202 indicating that there is no information to convey. After transmitting the message, the wireless transceiver of the entertainment device 102 switches to a receive mode (operation 310B), ready to receive another query from the remote control 106A and/or a command from the remote control 106A (operation 312B).

The wireless transceiver 202 of the remote control 106A receives the response message from the remote control 106A and transmits the message to the control logic 206 for further processing (operation 308A). The wireless transceiver 202 then turns off or otherwise enters a low power mode state until the remote control 106A is ready to transmit another query message (operation 310A). The control logic 206 then process the response message as appropriate (operation 312A). For example, the control logic 206 may command the sound emitting device 208 to emit a sound responsive to the message from the entertainment device 102.

Because the remote control 106A does not operate the wireless transceiver 202 in an active mode at all times, the battery life of the remote control 106A is increased. Operating the wireless transceiver 202 in an active mode at all times is power intensive and significantly shortens the life of the battery powering the remote control 106A. However, as described above, the remote control 106A may bi-directionally communicate with the entertainment device 102 and receive information as appropriate, such as requests to activate the sound emitting device 208, without activating the wireless transceiver 202 to listen for such requests at unnecessary times. Rather, the remote control 106A determines when to access such requests and other data from the entertainment device 102, and activates the wireless transceiver 202 as appropriate to exchange such data, conserving battery power and increasing the battery life for the battery of the remote control 106A. For example, the remote control 106A may exchange data with the entertainment device 102 according to a default timing period or may exchange data with the entertainment device 102 according to a schedule adjusted based on commands from the entertainment device 102.

Those of ordinary skill in the art will appreciate that the various functional elements 202 through 208 shown as operable within the remote control 106A may be combined into fewer discrete elements or may be broken up into a larger number of discrete functional elements as a matter of design choice. Thus, the particular functional decomposition suggested by FIG. 2 is intended merely as exemplary of one possible functional decomposition of elements within the remote control 106A.

Figure 4:
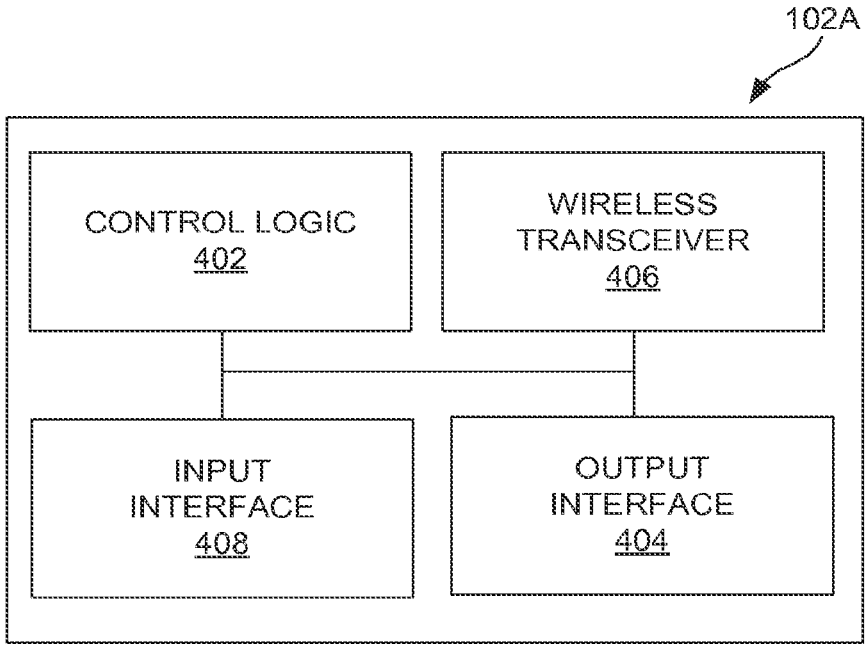
FIG. 4 illustrates an embodiment of an entertainment device of FIG. 1.

FIG. 4 illustrates an embodiment of an entertainment device 102A of FIG. 1. More particularly, FIG. 4 illustrates an entertainment device 102A embodied as a television receiver (e.g., a set-top box). However, it is to be appreciated that the entertainment device 102A may comprise any type of device that presents any type of presentation content, including DVD players, audio receivers, audio playback devices, video servers and internet connected video playback devices. FIG. 4 will be discussed in reference to the entertainment system 100 illustrated in FIG. 1. The entertainment device 102A includes control logic 402, an output interface 404, a wireless transceiver 406 and an input interface 408. Each of these components will be discussed in greater detail below. The entertainment device 102A may include other components or devices not illustrated for the sake of brevity.

The control logic 402 is operable for controlling the operation of the entertainment device 102A. As used herein, control logic 402 refers to a single processing device or a group of inter-operational processing devices. In at least one embodiment, the operation of the control logic 402 may be controlled by instructions executable by the control logic 402. Some examples of instructions are software, program code, and firmware. Additionally, the operation of particular functionalities of the control logic 402 is controllable based on commands received from a remote control 106 (see FIG. 1). In at least one embodiment, the control logic 402 includes at least a first operating state and a second operating state. The operating states may be of any type as described above.

In at least one embodiment, the control logic 402 is operable for receiving presentation content, e.g., video content. The control logic 402 may be operable for receiving and tuning any type of video content. For example, the control logic 402 may receive an over-the-air broadcast signal, an internet protocol video stream, a direct broadcast satellite signal or a cable television signal. In at least one embodiment, the control logic 402 includes a tuner for receiving video content from an external source, such as a television distribution network. The control logic 402 may also receive or retrieve content from a storage medium, such as an optical disk, internal or external hard drive, a portable storage device (e.g., universal serial bus (USB) memory sticks) and the like. The control logic 402 may also receive content from external servers, such as video servers, that are communicatively coupled to the entertainment device 102A over the internet or other type of data networks.

The output interface 404 is operable to interface with the presentation device 104 (see FIG. 1). More particularly, the output interface 404 is operable to output information for presentation by the presentation device 104. The output interface 404 may be operable to output any type of presentation data to the presentation device 104, including audio data, video data, audio/video (A/V) data, textual data, imagery or the like.

The output interface 404 may operate to perform various signal and data processing functions such as demodulation, decoding, decryption and the like on data signals received via any type of network interface, to generate an appropriate format video stream for output to the presentation device 104 (see FIG. 1). The output interface 404 may comprise multiple components, such as a demodulator, an audio decoder, a video decoder, a data decoder or a graphics processor to generate the video stream. Commands received from the remote control 106 are operable to control the output of audio and video content by the output interface 404. For example, the wireless transceiver 406 may receive a key code causing the output interface 404 to manipulate the output of the video content responsive to the key code. The output interface 404 operates to output a video stream for presentation by the presentation device 104. The video stream generated by the output interface 404 may include menus, electronic programming guides and the like that are navigable using commands received from the remote control 106.

The wireless transceiver 406 is operable to wirelessly receive and/or transmit data to the remote control 106. The wireless transceiver 406 may communicate with the remote control 106 utilizing any type of IR and/or RF communication link. In at least one embodiment, the wireless transceiver 406 receives a key code from the remote control 106, and responsively provides the key code to the control logic 402. The wireless transceiver 406 is further operable to exchange data with the remote control 106, such as IR database code updates, firmware updates and the like.

The wireless transceiver 406 is further operable to exchange operational state queries and operational state responses with the remote control 106. For example, the remote control 106 transmits an operational state query to the wireless transceiver 406. The wireless transceiver 406 receives the operational state response to the query from the control logic 402 and transmits the operational state response to the remote control 106. Thus, the remote control 106 utilizes the operational state response, as described above, to determine whether to transition to or from a limited power mode state.

The wireless transceiver 406 is also operational to transmit other data to the remote control 106. For example, the wireless transceiver 406 may transmit a command, generated by the control logic 402, requesting the remote control 106 to activate an audible, visual or physical indicator, such as a speaker, LED, vibration device or the like. A request to activate an indicator may be transmitted responsive to a query from the remote control 106. In other words, if the control logic 402 generates a request to activate an indicator, then the wireless transceiver 406 and/or control logic 402 queues such request until a query is received from the remote control 106.

The input interface 408 may comprise any type of input device, such as one or more buttons, a keypad, a touch panel or touch screen and the like for receiving input from the user 108. In one embodiment, the input interface 408 includes a lost remote recovery button by which a user 108 may request to locate the remote control 106. Responsive to input provided by the user 108, the control logic 402 generates a request to the remote control 106 to activate an audio or visual indicator. The wireless transceiver 406 then transmits such request to the remote control 106 during the next cycle of query/response exchanges between the entertainment device 102A and the remote control 106. For example, the remote control 106 may query the entertainment device 102A according to a pre-determined schedule, such as five seconds between queries.

The control logic 402 may also generate requests to activate the indicator of the remote control 106 based on input from other remote controls. For example, the entertainment device 102A may be associated with multiple remote controls, and a user may desire to locate a misplaced remote control 106. The user 108 may utilize another remote control or buttons of the entertainment device 102A to navigate menus outputted by the control logic 402 to request to locate the lost remote control 106. The control logic 402 responsively generates a request for the remote control 106 to activate the sound emitting device.

In at least one embodiment, the control logic 402 generates a request to activate the indicator of the remote control and specifies parameters for activation of the indicator. For example, the control logic 402 may specify tone, frequency, duration and the like for activation of a sound emitting device of the remote control 106. Such parameters may be determined based on the reason for activating the indicator, user defined preferences and the like. The control logic 402 may also generate a request to deactivate the indicator. For example, the control logic 402 may request the remote control 106 to deactivate a sound emitting device after a specified period of time or based on receipt of additional user input, via the input interface 408 or via another remote control.

Responsive to the user input, the control logic 402 is also operable to decrease the volume of the output of content associated with the entertainment device 102A. In at least one embodiment, the control logic 402 commands the output interface to decrease the volume of content outputted by the output interface 404 to the presentation device 104 (see FIG. 1). For example, the output interface 404 may mute the volume of content it outputs to the presentation device 104.

In at least one embodiment, the control logic 402 may initiate a decrease of the volume of the presentation device 104. For example, the control logic 402 may generate a command requesting the presentation device 104 to mute its volume. In at least one embodiment the wireless transceiver 104 responsively outputs the mute command to the television. The entertainment device 102A and the presentation device 104 may also be communicatively coupled by a data bus that allows the control logic 402 to initiate transmission of a mute command to the presentation device 104. In at least one embodiment, the wireless transceiver 404 comprises an IR blaster that transmits the command from the entertainment device 102A to the presentation device 104.

Figure 5:
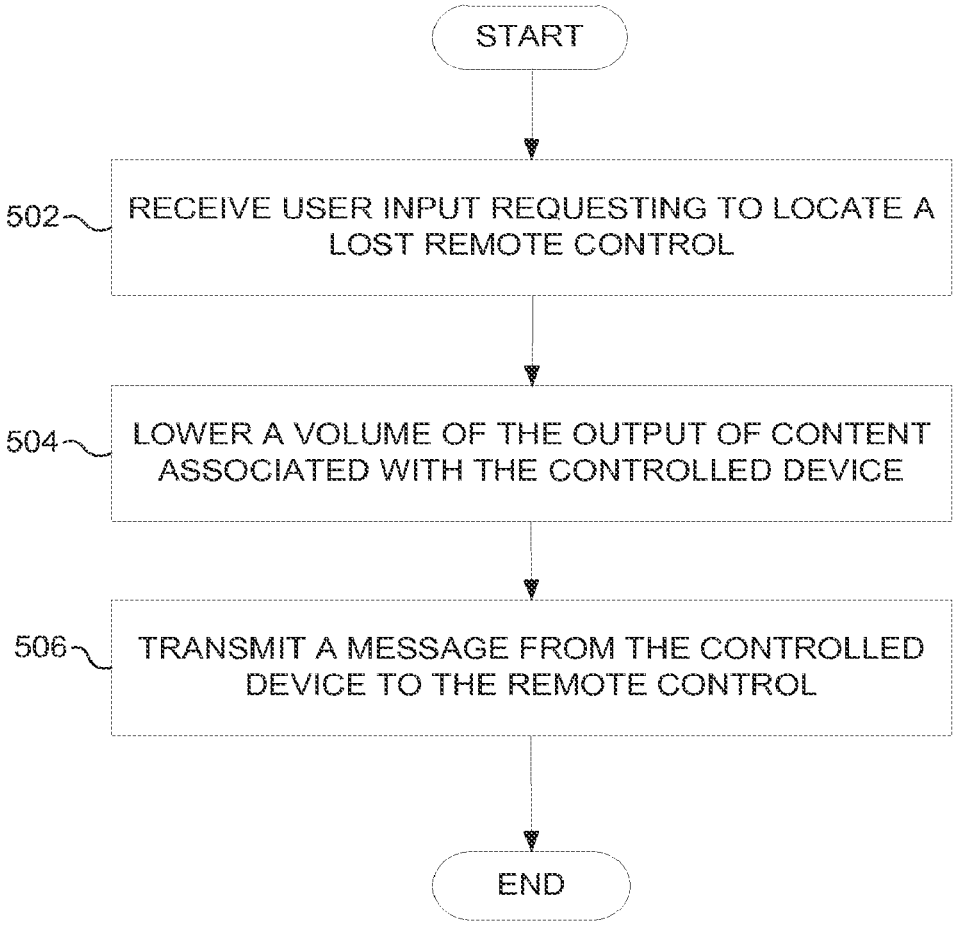
FIG. 5 illustrates an embodiment of a process for locating a lost remote control.

FIG. 5 illustrates an embodiment of a process for locating a lost remote control. It is to be appreciated that the process may be applied to remote controls for any type of controlled device. The process of FIG. 5 is not all inclusive, and may include other operations not illustrated for the sake of brevity.

The process includes receiving user input, at the controlled device, the user input requesting to locate a lost remote control for the controlled device (operation 502). In at least one embodiment, the input may be received via the controlled device directly, e.g., from buttons of the controlled device. The input may also be received by the controlled device indirectly, e.g., via another remote control. The process further include lowering a volume of the output of content associated with the controlled device responsive to the user input (operation 504).

The process further includes transmitting a message from the controlled device to the remote control, the message requesting the remote control to activate a sound emitting device of the remote control (operation 506). Responsive to the command, the remote control activates the sound emitting device, allowing the user to locate the lost remote control. It is to be appreciated that operations 504 and 506 may be performed sequentially or concurrently depending on desired design criteria.

Although specific embodiments were described herein, the scope of the invention is not limited to those specific embodiments. The scope of the invention is defined by the following claims and any equivalents therein.

I claim:

1. A method of locating a lost remote control, the method comprising:

receiving user input, at a controlled device, the user input requesting to locate a lost remote control for the controlled device; and lowering a volume of the output of content associated with the controlled device responsive to the user input.

2. The method of claim 1, wherein lowering the volume of the output of content further comprises: muting the volume of content outputted by the controlled device.

3. The method of claim 1, wherein lowering the volume of the output of content further comprises: muting the volume of a presentation device associated with the controlled device.

4. The method of claim 1, wherein transmitting the message further comprises: receiving a first query message at the controlled device from the remote control; and transmitting a first reply message to the remote control from the controlled device responsive to the first query message, the first reply message referencing the user input requesting to locate the lost remote control.

5. The method of claim 4, further comprising: receiving a second query message at the controlled device from the remote control; transmitting a second reply message from the controlled device to the remote control; and deactivating the indicator device of the remote control responsive to the second reply message received from the controlled device by the remote control.

6. The method of claim 5, wherein a duration of time between the transmission of the first query message and the second query message is determined based on a schedule that is independent of the content of the first reply message.

7. The method of claim 1, further comprising: activating a sound emitting device of the remote control responsive to the message received, from the controlled device, by the remote control.

8. The method of claim 1, wherein the controlled device comprises a television.

9. The method of claim 1, wherein the controlled device comprises an external television receiver.

10. The method of claim 1, wherein the controlled device comprises an audio output device.

11. An apparatus comprising:

an input interface that receives user input requesting to activate an indicator device of a remote control for the apparatus;

an output interface that outputs presentation content; and control logic that processes the user input and responsively lowers a volume of the presentation content and generates a message for transmission to the remote control.

12. The apparatus of claim 11, wherein the input interface receives the user input in association with a lost remote control locator feature of the apparatus.

13. The apparatus of claim 11, wherein the output interface outputs the presentation content to an associated presentation device and wherein the control logic is operable to mute the volume of the presentation content outputted by the output interface.

14. The apparatus of claim 11, wherein the output interface outputs content to an associated presentation device and wherein the control logic is operable to initiate transmission of a command to the presentation device to mute the volume of the presentation device.

15. The apparatus of claim 11, wherein the output interface is operable to present the presentation content and wherein the control logic is operable to mute the volume of the presentation content presented by the output interface.

16. The apparatus of claim 11, wherein the wireless interface receives a first query message, from the remote control, and transmits a first reply message, to the remote control, responsive to the first query message, the first reply message referencing the user input requesting to locate the lost remote control.

17. The apparatus of claim 16, wherein the wireless interface receives a second query message at the controlled device from the remote control and transmits a second reply message from the controlled device to the remote control, the remote control operating to deactivate the indicator device responsive to the second reply message.

18. A system comprising:

a remote control including:

a sound emitting device;

first control logic;

a first wireless transceiver that transmits a first query message; and an entertainment device including:

an input interface that receives user input requesting to locate the remote control;

an output interface that outputs a presentation stream for presentation on a presentation device;

second control logic that processes the user input and responsively lowers a volume of the presentation stream.

19. The system of claim 18, wherein the entertainment device comprises a television receiver.

20. The system of claim 18, wherein the entertainment device comprises an audio output device.

* * * * *